US008393696B2

(12) United States Patent
Leighton et al.

(10) Patent No.: US 8,393,696 B2
(45) Date of Patent: Mar. 12, 2013

(54) METHOD AND DEVICE FOR CONTROLLING THE MASS OF AN INK DROPLET

(75) Inventors: Roger G. Leighton, Rochester, NY (US); James J. Spence, Honeoye Falls, NY (US); Michael F. Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 344 days.

(21) Appl. No.: 12/631,902

(22) Filed: Dec. 7, 2009

(65) Prior Publication Data

US 2011/0134171 A1 Jun. 9, 2011

(51) Int. Cl.
*B41J 2/195* (2006.01)

(52) U.S. Cl. ..... 347/7; 347/5; 347/6; 347/84; 347/85

(58) Field of Classification Search ..... None
See application file for complete search history.

(56) References Cited

U.S. PATENT DOCUMENTS 4,183,030 A * 1/1980 Kaieda et al. ..... 347/6
4,490,731 A * 12/1984 Vaught ..... 347/88
5,422,664 A 6/1995 Stephany
5,992,990 A 11/1999 Childers et al.
6,137,513 A 10/2000 Pawlowski, Jr. et al.
6,164,742 A 12/2000 Hauck
6,250,747 B1 6/2001 Hauck
6,464,346 B2 10/2002 Otis, Jr. et al.
2005/0219337 A1 10/2005 Martinez-Pacheco
2008/0204501 A1 8/2008 Kurita et al.
2009/0040249 A1 * 2/2009 Wouters et al. ..... 347/7

* cited by examiner

*Primary Examiner* — Uyen Chau N Le
*Assistant Examiner* — Chad Smith
(74) *Attorney, Agent, or Firm* — Maginot, Moore & Beck, LLP

(57) ABSTRACT

An inkjet printing system controls an ink droplet mass by regulating a pressure in an ink reservoir. The printing system includes an ink reservoir, an air pressure device, an ink ejection device, and a controller. The ink reservoir is configured to contain a supply of ink and an air space above the supply of ink. The air pressure device is fluidly coupled to the air space above the supply of ink. The ink ejection device is fluidly coupled to the ink reservoir to receive ink from the supply of ink and to eject ink droplets onto an image receiving surface. The controller is coupled to the air pressure device and is configured to activate the air pressure device selectively to change a mass of the ink droplets ejected by the ink ejection device.

17 Claims, 2 Drawing Sheets

METHOD AND DEVICE FOR CONTROLLING THE MASS OF AN INK DROPLET

TECHNICAL FIELD

The method and device described below relate to inkjet imaging devices and, more particularly, to the printheads of inkjet imaging devices.

BACKGROUND

Inkjet printers form a printed image by ejecting or "jetting" droplets of liquid ink onto an image receiving surface, such as an intermediate transfer surface or a media substrate. The benefits of inkjet printing include low printing noise, low cost per printed page, and the ability to print "full color" images. Inkjet printers typically include a printhead and a printhead controller. The printhead controller, among other functions, sends ejection signals to the printhead. The ejection signals cause the printhead to eject droplets of liquid ink upon an image receiving surface to form at least a portion of a printed image.

In general, the printhead of an inkjet printer includes a plurality of ink ejectors and at least one reservoir for containing a supply of ink. Specifically, a monochromatic inkjet printhead may include a single reservoir for containing a single color of ink. A full color inkjet printhead may include a plurality of reservoirs, with each reservoir configured to contain a different color of ink. The ink ejectors eject very small droplets of the ink onto an image receiving surface in response to receiving an ejection signal from the printhead controller. Often, a group of one hundred to six hundred individual ink ejectors are coupled by a manifold to a reservoir. In particular, a monochromatic printhead may include a single group of ink ejectors fluidly coupled to the single reservoir, while a full color printhead may include a separate group of ink ejectors for each of the reservoirs. Thus, a full color printhead having four reservoirs may have four distinct groups of ink ejectors, each being coupled to a different ink reservoir.

The ink ejectors of some inkjet printers eject ink droplets having a fixed mass. The ejected ink droplets, therefore, form regions of ink upon an image receiving surface that have an approximately fixed area. In some instances, it would be advantageous to control the area of the regions of ink formed by the ink droplets ejected upon the image receiving surface. Consequently, further developments in the area of inkjet printheads are desirable.

SUMMARY

An inkjet printing system has been developed that controls an ink droplet mass by regulating a pressure in an ink reservoir. The printing system includes an ink reservoir, an air pressure device, at least one ink ejection device, and a controller. The ink reservoir is configured to contain a supply of ink and an air space above the supply of ink. The air pressure device is fluidly coupled to the air space above the supply of ink. The at least one ink ejection device is fluidly coupled to the ink reservoir to receive ink from the supply of ink and to eject ink droplets onto an image receiving surface. The controller is coupled to the air pressure device and is configured to activate the air pressure device selectively to change a mass of the ink droplets ejected by the at least one ink ejection device.

An inkjet printer has been developed that controls an ink droplet mass by regulating a pressure in an ink reservoir. The printer includes a printhead, an air pressure device, and a printhead controller. The printhead includes an ink reservoir configured to contain a supply of ink and an air space above the supply of ink. The printhead also includes at least one ink ejection device fluidly coupled to the ink reservoir and configured to receive ink from the supply of ink and to eject ink droplets onto an image receiving surface. The air pressure device is fluidly coupled to the air space above the supply of ink. The printhead controller is coupled to the air pressure device and is configured to activate the air pressure device selectively to control a mass of the ink droplets ejected by the at least one ink ejection device.

A method has also been developed for controlling an ink droplet mass by controlling a pressure of an air space above a supply of ink. The method includes fluidly coupling at least one ink ejection device to a supply of ink contained in an ink reservoir. Furthermore, the method includes fluidly coupling a source of air pressure to the ink reservoir, and regulating a pressure of an air space above the supply of ink with the source of air pressure to control a mass of an ink droplet ejected by the at least one ink ejection device.

BRIEF DESCRIPTION OF THE FIGURES

The foregoing aspects and other features of the present disclosure are explained in the following description, taken in connection with the accompanying figures.

DETAILED DESCRIPTION

The device and method described herein make reference to a printer. The term "printer" refers, for example, to reproduction devices in general, such as printers, facsimile machines, copiers, and related multi-function products. While the specification focuses on an inkjet printer, the device and method described herein may be used with any printer, which ejects ink directly or indirectly onto an image receiving surface. Furthermore, the device and method described herein may be used with printers, which form printed images with either aqueous ink, phase change ink, or gel ink.

Figure 1:
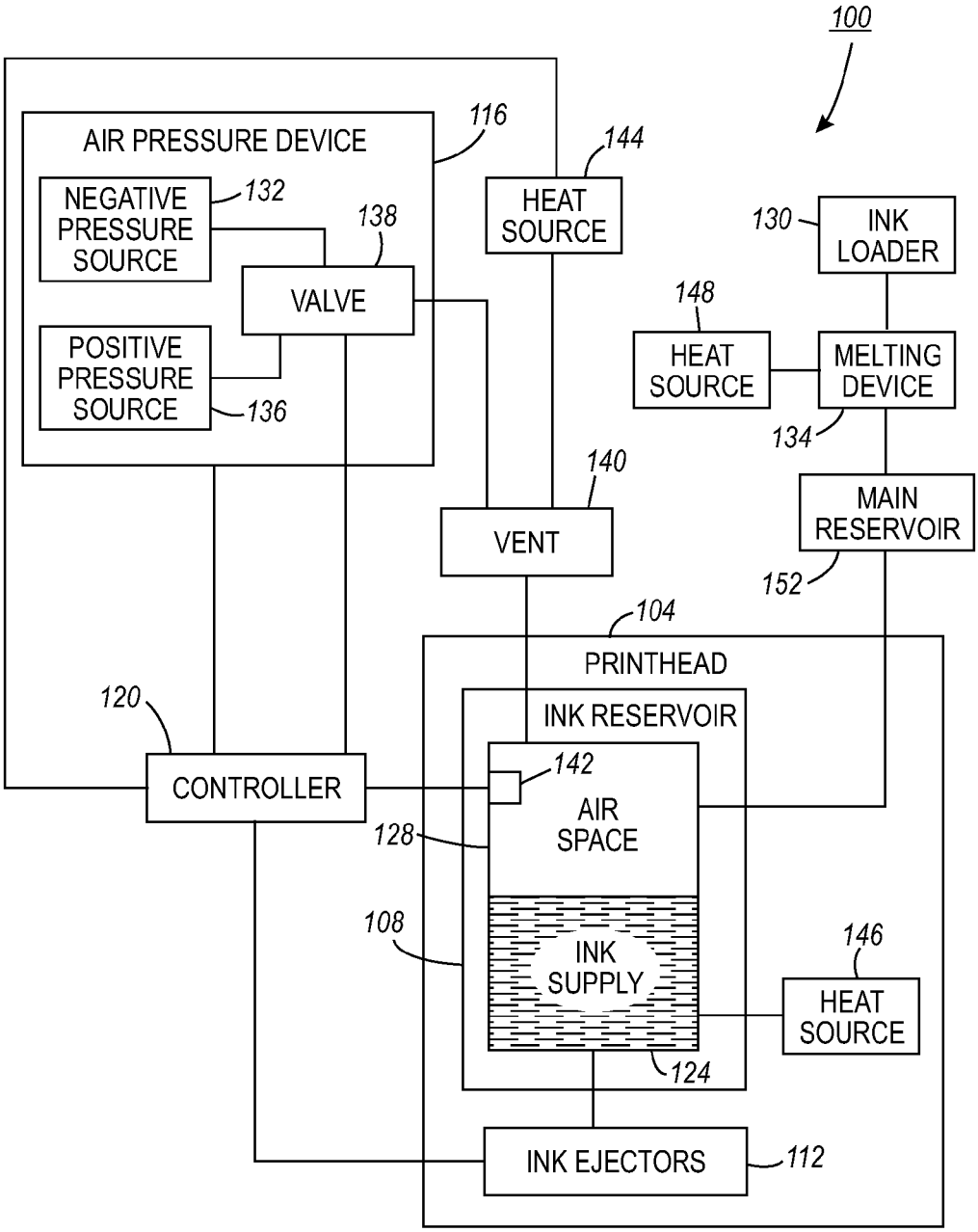
FIG. 1 is a block diagram illustrating an inkjet printing system as described herein.

As shown in FIG. 1, a block diagram of a printer 100 is provided. The printer 100 ejects droplets of liquid ink onto an image receiving surface (not illustrated) to form at least a portion of a printed image. The term "liquid ink" as used herein, includes, but is not limited to, aqueous inks, liquid ink emulsions, pigmented inks, phase change inks in a liquid phase, and gel inks that are heated or otherwise treated to alter the viscosity of the ink for improved jetting. The printer 100 includes, among other components, a printhead 104 having at least one ink reservoir 108 and at least one corresponding group of ink ejectors 112, an air pressure device 116, and a controller 120. The reservoir 108 contains a supply of liquid ink 124 and defines an air space 128 above the ink 124. The ink ejectors 112 are fluidly coupled to the reservoir 108 for ejecting ink droplets of the supply of ink 124 onto the image receiving surface. The air pressure device 116 is fluidly coupled to the air space 128 for controlling an air pressure of the air space 128. The controller 120, among other functions, controls the mass of the ink droplets ejected by the ink ejectors 112 by selectively activating the air pressure device 116 to regulate an air pressure of the air space 128.

The ink reservoir 108 defines a volume for containing the ink 124 and the air space 128. The reservoir 108 may have a cross section of any shape, including, but not limited to, rectangular, circular, and elliptical. The supply of ink 124 may be any ink suitable for ejection by the ink ejectors 112, including, but not limited to, phase change ink, gel ink, and aqueous ink, as described below. The air space 128 is a volume of the reservoir 108 that is unoccupied by the ink 124. The reservoir 108 may define a closed space that is isolated from the atmosphere, to permit the air pressure device 116 to maintain a particular gauge pressure in the air space 128. As used herein, gauge pressure refers to a pressure level relative an ambient air pressure surrounding the printer 100. The ambient air pressure is often the atmospheric pressure. Therefore, gauge pressure may be an absolute pressure minus the atmospheric pressure. A manifold (not illustrated) fluidly couples the reservoir 108 to the ink ejectors 112.

The printer 100 may be configured to form printed images with phase change ink and/or gel ink. The term "phase change ink" encompasses inks that remain in a solid phase at an ambient temperature and that melt into a liquid phase when heated above a threshold temperature, referred to as a melt temperature. The ambient temperature is the temperature of the air surrounding the printer 100. The ambient temperature may be a room temperature when the printer 100 is positioned in a defined space. The ambient temperature may be above a room temperature when portions of the printer 100, such as the printhead 104, are enclosed by, for example, a cover. An exemplary range of melt temperatures is approximately seventy to one hundred forty degrees Celsius; however, the melt temperature of some types of phase change ink may be above or below the exemplary temperature range. Phase change ink is ejected onto a substrate in the liquid phase. The terms "gel ink" or "gel-based ink" encompass inks that remain in a gelatinous state at the ambient temperature and that may be altered to have a different viscosity suitable for ejection by the printhead 104. In particular, gel ink in the gelatinous state may have a viscosity between 10 and 13 centistokes ("cS"); however, the viscosity of gel ink may be reduced, to a liquid-like viscosity suitable for ejection, by heating the ink above a threshold temperature, referred to as a gelation temperature. An exemplary range of gelation temperatures is approximately seventy five to eighty five degrees Celsius; however, the gelation temperature of some types of gel ink may be above or below the exemplary temperature range.

Some inks, including gel inks, may be cured during the printing process. Radiation curable ink becomes cured after being exposed to a source of radiation. Suitable radiation may encompass the full frequency (or wavelength) spectrum, including but not limited to, microwaves, infrared, visible, ultraviolet, and x-rays. In particular, ultraviolet-curable gel ink, referred to herein as UV gel ink, becomes cured after being exposed to ultraviolet radiation. As used herein ultraviolet radiation includes radiation having a wavelength between ten nanometers to four hundred nanometers.

As shown in FIG. 1, a printer 100 configured to form images with phase change ink and/or gel ink may include an ink loader 130, a melting device 134, and a main reservoir 152. The ink loader 130 contains a quantity of phase change ink in the solid phase or a quantity of gel ink in the gelatinous phase. Phase change ink is supplied to the ink loader 130 as solid ink pellets or solid ink sticks, among other forms. Gel ink is supplied to the ink loader 130 in a gelatinous form. The ink loader 130 moves the phase change ink or the gel ink toward the melting device 134, which heats at least a portion of the ink to form liquid ink. The liquid ink is delivered to the main reservoir 152, which is thermally coupled to a heater 148 through the melting device 134. The heater 148 is configured to maintain the main reservoir 152 at a temperature that maintains the ink in the liquid phase. Liquid ink from the main reservoir 152 is delivered to the ink reservoir 108 for ejection by the ink ejectors 112. The printhead 104 may include a heater 146 for maintaining the ink contained by the ink reservoir 108 in the liquid phase.

The main reservoir 152 and the ink reservoir 108 remain connected to the printer 100 during normal usage and servicing of the printer 100. Specifically, in response to the ink level in the ink reservoir 108 falling below a predetermined level, the printer 100 refills the ink reservoir 108 with liquid ink from the main reservoir 152. Similarly, in response to the ink level in the main reservoir 152 falling below a predetermined level, the melting device 134 heats a portion of the ink in the ink loader 130 and fills the main reservoir 152 with additional liquid ink. Accordingly, in one embodiment, neither the main reservoir 152 nor the ink reservoir 108 are disposable units configured to be replaced in response to the printer 100 exhausting an ink supply.

The ink ejectors 112 eject droplets of liquid ink onto an image receiving surface in response to receiving an ejection signal from the controller 120. As used herein, ejecting ink onto a substrate includes, but is not limited to, ejecting ink with thermal ink ejectors and ejecting ink with piezoelectric ink ejectors. The ink ejectors 112 may be positioned to eject ink droplets in a downward direction. For instance, the ink ejectors 112 may be positioned to eject ink droplets in a downward direction no more than fifteen degrees from vertical. Alternatively, the ink ejectors 112 may be positioned to eject ink droplets in a lateral direction no more than thirty degrees from horizontal.

The mass of the ink droplets ejected by the ink ejectors 112 is at least partially determined by the air pressure of the air space 128. In particular, in response to the air pressure in the air space 128 being approximately equal to the atmospheric pressure, the ink ejectors 112 eject liquid ink droplets having a default mass. In response, however, to the air pressure within the air space 128 being other than the atmospheric pressure, the ink ejectors 112 eject liquid ink droplets having a mass other than the default mass, as described below.

The air pressure device 116 is fluidly coupled to the air space 128 and is electrically coupled to the controller 120. The air pressure device 116 is configured to control an air pressure of the air space 128 in response to being selectively activated by the controller 120. As shown in FIG. 1, the air pressure device 116 includes a negative air pressure source 132, a positive air pressure source 136, and a valve 138. The negative air pressure source 132 withdraws air from the air space 128 to maintain a negative gauge pressure in the air space 128 during the printing process. The negative pressure maintains the internal meniscus on a print face (not illustrated) of the printhead 104 during printing. Additionally, the negative pressure prevents liquid ink from seeping from the printhead 104. The positive air pressure source 136 injects air into the air space 128 to maintain a positive gauge pressure in the air space 128. The positive pressure may be used for purging ink from the ink ejectors 112 and to clean or otherwise maintain the printhead 104. The negative air pressure source 132 and the positive air pressure source 136 may be any type of pressure source including, but not limited to, positive displacement pumps. Depending on the embodiment, the air pressure device 116 may be coupled to a source of electrical power (not illustrated).

The valve 138 is fluidly coupled to the reservoir 108, the negative air pressure source 132, and the positive air pressure source 136. As shown in the embodiment of FIG. 1, the valve 138 is also electrically coupled to the controller 120. In a first position, the valve 138 couples the negative pressure source 132 to the reservoir 108 and decouples the positive pressure source 136 from the reservoir 108. In a second position, the valve 138 couples the positive pressure source 136 to the reservoir 108 and decouples the negative pressure source 132 from the reservoir 108. The valve 138 is moved between the first and second positions in response to electronic signals generated by the controller 120.

The controller 120 controls the mass of the ink droplets ejected by the ink ejectors 112 by selectively activating the air pressure device 116 to increase or to decrease the air pressure in the air space 128. For instance, the controller 120 may activate the air pressure device 116 to maintain a negative gauge pressure in the air space 128. In particular, the controller 120 sends an electronic signal to the air pressure device 116 that causes the air pressure device 116 to move the valve 138 to a position, which couples the air space 128 to the negative pressure source 132. The negative pressure of the air space 128 tends to prevent the liquid ink in the reservoir 108 from exiting the reservoir 108 through the ink ejectors 112; consequently, in response to receiving an ejection signal from the controller 120, the ink ejectors 112 eject ink droplets having a mass less than the default ink droplet mass. An exemplary negative gauge pressure is 0.5 to 6.0 inches of water. In general, increasing the magnitude of the negative gauge pressure reduces the mass of the ink droplets ejected by the ink ejectors 112.

As illustrated in the embodiment of FIG. 1, the controller 120 is electrically coupled to a sensor 142. The sensor 142 is positioned in the air space 128 for generating a control signal indicative of the air pressure in the air space 128. The controller 120 compares the air pressure of the air space 128, as sensed by the sensor 142, to an air pressure set point and activates selectively the air pressure device 116 to maintain the air pressure set point. The sensor 142 is any type of sensor capable of generating a signal indicative of a gauge air pressure within a range of approximately −10.0 to 0 inches of water.

The printer 100 includes a vent 140 configured to couple fluidly the air space 128 to the air pressure device 116. In the embodiment illustrated in FIG. 1, a first end of the vent 140 is connected to an opening in the reservoir 108, and a second end of the vent 140 is connected to the valve 138 of the air pressure device 116. The air pressure device 116 may force air into the air space 128 through the vent 140. Alternatively, the air pressure device 116 may withdraw air from the air space 128 through the vent 140. The vent 140 forms an air and liquid impervious seal with both the air pressure device 116 and the reservoir 108 to enable the air pressure device 116 to maintain a positive or negative gauge pressure within the air space 128. The vent 140 may exhibit a degree of rigidity to permit the vent 140 to maintain an approximately fixed inner dimension when subjected to an increased or decreased air pressure level. In one embodiment, the vent 140 is a hollow tube exhibiting a degree of flexibility to permit the vent 140 to couple easily the air pressure device 116 to the reservoir 108 via a curved or irregular path.

A heat source 144 is thermally coupled to the vent 140 for heating the vent 140. As described above, air may be withdrawn from or injected into the air space 128 through the vent 140; consequently, a portion of the ink supply 124 may also be drawn into the vent 140. The liquid ink drawn into the vent 140 may restrict the air flow through the vent 140, and thus may prevent the controller 120 from efficiently regulating the pressure level of the air space 128. For instance, if the ink drawn into the vent 140 is a phase change ink or a gel ink, the ink may cool to a temperature that causes the ink to solidify or to gelatinize, at least partially. The solidified or gelatinized ink may restrict the flow of air through the vent 140. Coupling a heat source 144 to the vent 140 prevents ink within the vent 140 from solidifying or gelatinizing. Maintaining the ink drawn into the vent 140 in a liquid phase enables a positive air flow directed into the air space 128 from the positive pressure source 136 to remove the ink from the vent 140.

The heat source 144 may contact a portion or the entire length of the vent 140. In some embodiments, the heat source 144 is a resistive heating element coupled to a source of electrical power. Additionally, the heat source 144 may be electrically coupled to the controller 120 to enable the controller 120 to activate selectively the heat source 144 in order to regulate the temperature of the vent 140. Embodiments of the printer 100 including a heat source 144 also include a vent 140 formed of a thermally conductive material that remains stable at temperatures at least as great as the maximum temperature of the heat source 144.

In one embodiment, the air pressure device 116 is configured to expel ink deposits and other obstructions from the ink ejectors 112 with positive air pressure. For instance, some types of inks may harden within an ink ejector 112 causing the ink ejector 112 to fail to eject an ink droplet upon receiving an ejection signal. Upon detection of one or more failed ejectors, the controller 120 may activate the positive pressure source 136 to cause a positive gauge pressure to develop in the air space 128 that expels ink from the ink ejectors 112. The expulsion of ink forces ink deposits and other obstructions from the ink ejectors 112. This controlled expulsion of ink from the ink ejectors 112 to clear clogged ejectors 112 is referred to herein as "purging". In one embodiment, the air pressure device 116 may generate a positive air pressure in the air space 128 of approximately four pounds per square inch ("psi") when purging the ink ejectors 112.

Figure 2:
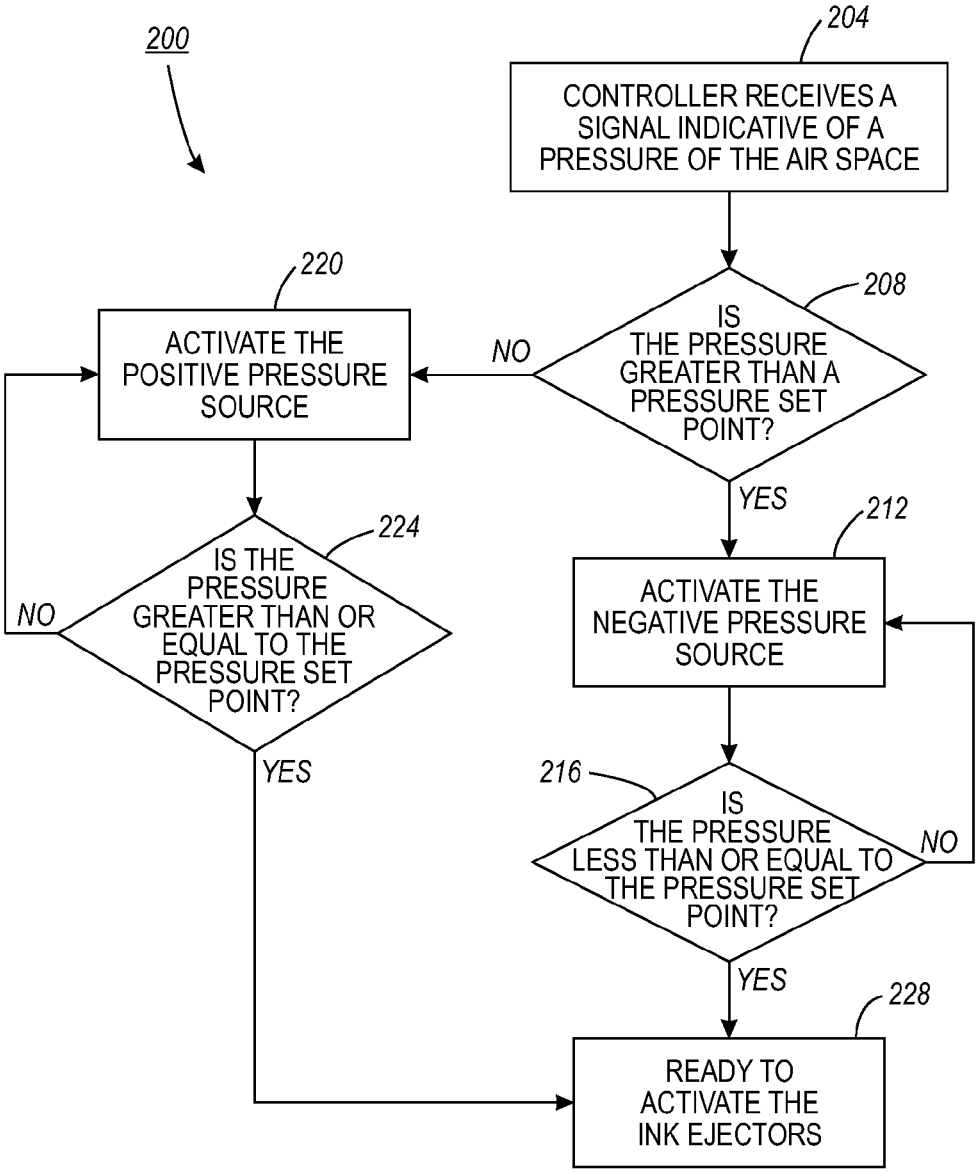
FIG. 2 is a flowchart illustrating a process for operating the inkjet printing system of FIG. 1.

In operation, the embodiment of the printer 100 illustrated in FIG. 1 controls the mass of the liquid ink droplets ejected by the ink ejectors 112, according to the process 200 of FIG. 2. The process 200 begins with the controller 120 receiving from the sensor 142 an electronic signal that is indicative of the pressure of the air space 128 (block 204). Next, the controller 120 compares the pressure of the air space 128 to a pressure set point (block 208). The pressure set point may be specific to the type of image to be printed, the type of image receiving substrate, or the type of ink supply 112. Additionally, the pressure set point may correspond to a purge pressure. If the pressure of the air space 128 is greater than the pressure set point the controller 120 couples the negative pressure source 132 to the air space 128 until the pressure of the air space 128 is equal to or less than the pressure set point (blocks 212 and 216). Similarly, if the pressure of the air space 128 is less than the pressure set point the controller 120 couples the positive pressure source 136 to the air space 128 until the pressure of the air space 128 is equal to or greater than the pressure set point (blocks 220 and 224). In response to the pressure in the air space 128 being approximately equal to the pressure set point, the ink ejectors 112 may be activated by the controller 120 (block 228). Throughout the process 200, the controller 120 may also energize the heat source 144 coupled to the vent 140 in order to prevent phase change inks and gel inks from solidifying or gelatinizing within the vent 140.

The embodiment of the air pressure device 116 illustrated in FIG. 1 is operable to control an ink droplet mass for all types of ink configured to be ejected as liquid ink from an ink ejector 112. The air pressure imparted on the air space 128 may depend, at least in part, on the viscosity of the liquid ink in the reservoir 108. Liquid ink formed from phase change ink and gel ink often has a viscosity that is greater than the viscosity of aqueous ink. Therefore, compared to the magnitude of negative pressure required to reduce the mass of an aqueous ink droplet by a certain percentage, a lesser magnitude of negative pressure may be required to reduce the mass of a solid-ink ink droplet or a gel-ink ink droplet by the same percentage. This is because liquid ink having a comparatively high viscosity tends to resist flowing from the reservoir 108 through the ink ejectors 112 to a greater extent than liquid ink having a comparatively low viscosity. Accordingly, the air pressure device 116 may be configured to impart an air pressure level or a range of air pressure levels upon the air space 128 based on the type and/or properties of the liquid ink contained by the reservoir 108.

Those skilled in the art will recognize that numerous modifications may be made to the specific implementations described above. Therefore, the following claims are not to be limited to the specific embodiments described above and illustrated in the figures referenced herein. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet printing system comprising:

an ink reservoir configured to contain a supply of ink and an air space above the supply of ink;

an air pressure device fluidly coupled to the air space above the supply of ink, the air pressure device having a negative pressure source configured to withdraw air from the air space above the supply of ink, a positive pressure source configured to inject air into the air space above the supply of ink, and a valve configured to couple either the negative pressure source or the positive pressure source to the air space above the supply of ink;

at least one ink ejection device fluidly coupled to the ink reservoir, the at least one ink ejection device configured to receive ink from the supply of ink and to eject ink droplets onto an image receiving surface; and a controller coupled to the valve of the air pressure device, the controller being configured to operate the valve to selectively couple either the negative pressure source or the positive pressure source to the air space above the supply of ink to produce a pressure in the ink reservoir that corresponds to a pressure setpoint, the pressure in the ink reservoir alone changing a mass of the ink droplets ejected by the at least one ink ejection device in response to the controller activating the at least one ink ejection device.

2. The inkjet printing system of claim 1, further comprising:

a vent configured to couple fluidly the air space above the supply of ink to the air pressure device; and a heat source coupled to the vent, the heat source configured to heat the vent to a predetermined temperature.

3. The inkjet printing system of claim 1, further comprising:

a sensing element positioned within the air space above the supply of ink and electrically coupled to the controller, the sensing element being configured to generate a pressure signal indicative of the pressure in the air space above the supply of ink, and the controller being configured to activate the air pressure device in response to the pressure signal generated by the sensing element.

4. The inkjet printing system of claim 1, further comprising:

an ink melting device configured to supply the ink reservoir with liquid ink.

5. The inkjet printing system of claim 4, further comprising:

a plurality of ink ejectors fluidly coupled to the reservoir; and a heat source configured to heat the ink reservoir to a predetermined temperature configured to enable ejection of the liquid ink by the ink ejectors.

6. The inkjet printing system of claim 1, the negative pressure source generating a negative pressure in the air space above the supply of ink of 0.5 to 6.0 inches of water, and the positive pressure source generating a positive pressure in the air space above the supply of ink of 4.0 psi.

7. An inkjet printer comprising:

a printhead having an ink reservoir within the printhead and at least one ink ejection device positioned within the printhead, the ink reservoir configured to contain a supply of ink and an air space above the supply of ink, the at least one ink ejection device fluidly coupled to the ink reservoir and configured to receive ink from the supply of ink and to eject ink droplets onto an image receiving surface;

a valve fluidly coupled to the air space above the supply of ink; and a printhead controller coupled to the valve and configured to operate the valve selectively to couple either a negative pressure source or a positive pressure source to the air space above the supply of ink to change a mass of the ink droplets ejected by the at least one ink ejection device.

8. The inkjet printer of claim 7, further comprising:

a heat source coupled to the vent, the heat source configured to heat the vent to a predetermined temperature.

9. The inkjet printer of claim 8, the predetermined temperature configured to prevent liquid ink from one of solidifying and gelatinizing within the vent.

10. The inkjet printer of claim 7, further comprising:

a sensing element positioned within the air space above the supply of ink and electrically coupled to the printhead controller, the sensing element being configured to generate a pressure signal indicative of the pressure in the air space above the supply of ink, and the printhead controller being configured to activate the valve in response to the pressure signal generated by the sensing element.

11. The inkjet printer of claim 7, the controller being configured to apply a purge pressure from the positive pressure source to the ink reservoir and the at least one ink ejection device.

12. The inkjet printer of claim 7, further comprising:

an ink melting device configured to supply the ink reservoir with liquid ink; and a heat source configured to heat the ink reservoir to a predetermined temperature configured to enable ejection of the liquid ink by the at least one ink ejection device.

13. A method of changing a mass of an ink droplet ejected from an ink reservoir of an inkjet printer, the method comprising:

fluidly coupling at least one ink ejection device in a printhead to a supply of ink contained in an ink reservoir, a flow of ink from the supply of ink to the at least one ejection device in the printhead terminating at the at least one ejection device;

operating a valve to fluidly couple either a negative pressure source or a positive pressure source to an air space that is above the supply of ink in the ink reservoir; and regulating a pressure of the air space in the reservoir alone with the negative pressure or positive pressure source to change a mass of an ink droplet ejected by the at least one ink ejection device in response to a controller activating the at least one ink ejection device.

14. The method of claim 13, further comprising:

coupling a vent to the valve to couple the negative or positive pressure source to the air space above the supply of ink with a vent; and heating the vent with a heat source to a predetermined temperature.

15. The method of claim 13, further comprising:

sensing the pressure of the air space above the supply of ink with a sensor positioned in the ink reservoir, the sensor configured to generate a control signal; and activating selectively the valve with an electronic controller in response to the control signal.

16. The method of claim 13, the negative pressure source being configured to withdraw air from the air space above the supply of ink to decrease the mass of the ink droplets ejected by the at least one ink ejection device.

17. The method claim 13, further comprising:

heating a quantity of ink with a first heat source to form liquid ink;

receiving the liquid ink into the ink reservoir; and heating the ink reservoir with a second heat source to a predetermined temperature configured to enable ejection of the liquid ink by the at least one ink ejector device.

* * * * *